United States Patent [19]

Shigematsu

[11] Patent Number: 4,991,577

[45] Date of Patent: Feb. 12, 1991

[54] EXHALATION VALVE MEANS OF A RESPIRATION MASK

[75] Inventor: Nobuo Shigematsu, Urawa, Japan

[73] Assignee: Shigematsu Works Co., Ltd., Tokyo, Japan

[21] Appl. No.: 248,929

[22] Filed: Sep. 26, 1988

[30] Foreign Application Priority Data

Jan. 25, 1988 [JP] Japan ..... 63-7081

[51] Int. Cl.[5] ..... A62B 18/10; A62B 18/02

[52] U.S. Cl. ..... 128/207.12; 128/205.24; 128/205.25; 128/206.12

[58] Field of Search ..... 128/201.28, 205.24, 128/207.12, 207.16, 205.25

[56] References Cited

U.S. PATENT DOCUMENTS

| | | | |
|---|---|---|---|
| 2,629,375 | 2/1953 | Holmes | 128/205.24 |
| 3,262,447 | 7/1966 | Burke | 128/207.16 |
| 3,342,200 | 9/1967 | Wilcox | 128/207.12 |
| 3,575,206 | 4/1971 | Ulmann | 128/207.12 |
| 3,973,588 | 8/1976 | Holst | 128/201.28 |
| 4,004,603 | 1/1977 | Jones | 128/205.24 |
| 4,850,346 | 7/1989 | Michel et al. | 128/207.12 |

FOREIGN PATENT DOCUMENTS

| | | | |
|---|---|---|---|
| 831668 | 6/1938 | France | 128/207.12 |

*Primary Examiner*—Edgar S. Burr
*Assistant Examiner*—Kimberly L. Asher
*Attorney, Agent, or Firm*—Larson and Taylor

[57] ABSTRACT

An exhalation valve means of a positive pressure type respiration mask which can be easily converted to a non-positive pressure type (atmospheric pressure type) mask when necessary.

The exhalation valve means includes a valve body unit, which comprises an exhalation value seat, a valve body supporting member which is detachably mounted within an exhalation valve chamber, and a valve body which is supported by said valve body supporting member and energized against said exhalation valve seat. Said valve seat has a means for mounting a rubber membrane valve body which is used for the valve body unit.

6 Claims, 5 Drawing Sheets

EXHALATION VALVE MEANS OF A RESPIRATION MASK

FIELD OF THE INVENTION

This invention relates to a respiration mask and in particular, to an exhalation valve means of a respirator having a mask body which covers the whole face of a wearer and a valve body unit used in such an exhalation valve means.

DESCRIPTION OF THE PRIOR ART

Respiration masks have two types, one of which is a positive pressure type which has, as an exhalation valve means (exhaust valve means), a valve means having a valve body which is energized toward the closed position by a spring and which in use the interior of the mask is always maintained under a pressure above atmospheric pressure i.e. under positive pressure, and the other of which is a nonpositive pressure type which has a valve means having a rubber membrane valve body which is fixed at its center on a valve seat body and is in close contact at its peripheral portion with a valve seat due to its own elasticity. Although the difference between the both is only in the construction of the exhalation valve means, the respiration masks of the positive pressure type and the non-positive pressure type have so far been manufactured, bought and used as quite different masks.

SUMMARY OF THE INVENTION

The object of the present invention is to eliminate the uselessness that the respiration masks of the two types are manufactured, bought and used as different masks, though the difference is only in the construction of the exhalation valve means. That is, the object of the present invention is to provide a mask which can be converted for use to a non-positive pressure type mask or a positive pressure type mask when necessary, and a valve body unit which can convert a non-positive pressure type mask known or currently in use to a positive pressure type mask.

Thus, according to the present invention, the user who uses exchangingly both the positive pressure type and non-positive pressure type masks will no longer be necessary to buy and keep the two kinds of masks. Further, according to the present invention, a person who already has a known non-positive pressure type mask can alter it to a positive pressure type mask by buying only a valve body unit according to the present invention.

The characteristic feature of the present invention lies in a construction of an exhalation valve means of a respiration mask, wherein a valve body unit is disposed in an exhalation valve chamber, said unit consisting of a valve body supporting member which is detachably and firmly mounted in the exhalation valve chamber by a suitable means, a valve body which is supported by said valve body supporting member and movable to a position where it is brought into contact with said valve seat or to a position where it is separated away from said valve seat, and means which energizes said valve body against said valve seat under a desired pressing force, and said valve seat is provided approximately at its center with a mounting portion for a membrane valve body which is used when converting the respirator to the non-positive pressure type.

Another characteristic feature of the present invention lies in a construction of an exhalation valve of a respiration mask, wherein a valve body unit is disposed in an exhalation valve chamber, said unit consisting of a valve body supporting member which is detachably and firmly mounted in the exhalation valve chamber by a plurality of leg pieces being in contact with the inner surface of the side walls of the exhalation valve chamber, a valve body which is supported by said valve body supporting member and movable to a position where it is brought into contact with said valve seat or to a position where it is separated away from said valve seat, and means which energizes said valve body against said valve seat under a desired pressing force, and said valve seat is provided approximately at its center with a mounting portion for a membrane valve body which is used when converting the respirator to the non-positive pressure type.

A further characteristic feature of the present invention resides in a valve body unit which consists of a valve body supporting member which is to be detachably and firmly mounted in the exhalation valve chamber by a plurality of leg pieces being contacted with the inner surface of the side walls of the exhalation valve chamber, a valve body which is supported by said valve body supporting member and movable to a position where it is brought into contact with said valve seat or to a position where it is separated away from said valve seat, and means which energize said valve body against said valve seat under a desired pressing force.

For further understanding of the invention the invention will now be described more in detail by way of a preferred embodiment with reference to the accompanying drawings.

DESCRIPTION OF THE PREFERRED EMBODIMENT

Figure 1:
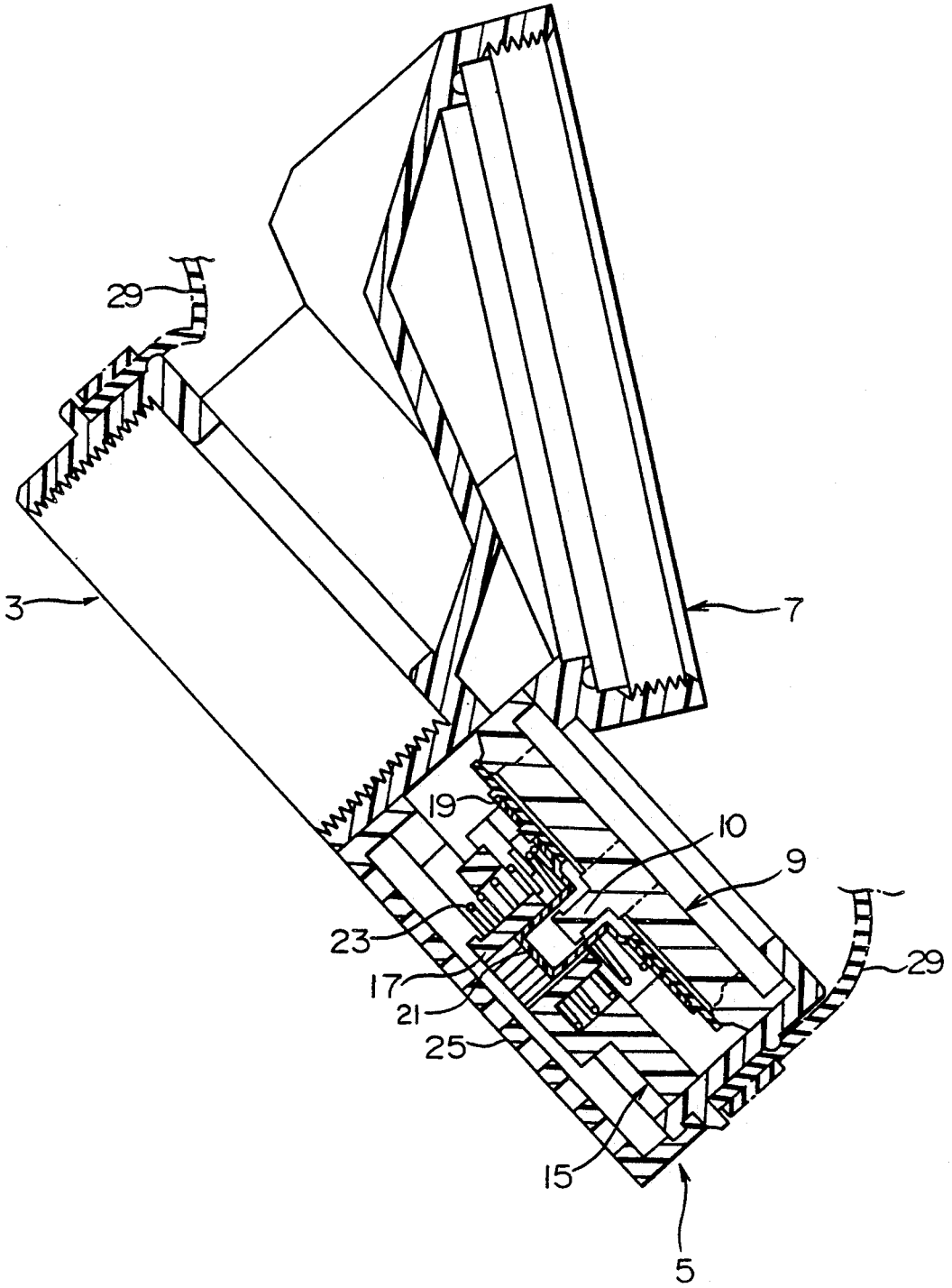
FIG. 1 is a vertical sectional view of a respiration air chamber of a respirator having a mask body which covers the whole face of a wearer, which is provided with a positive pressure exhalation valve means according to the present invention.
Figure 2:
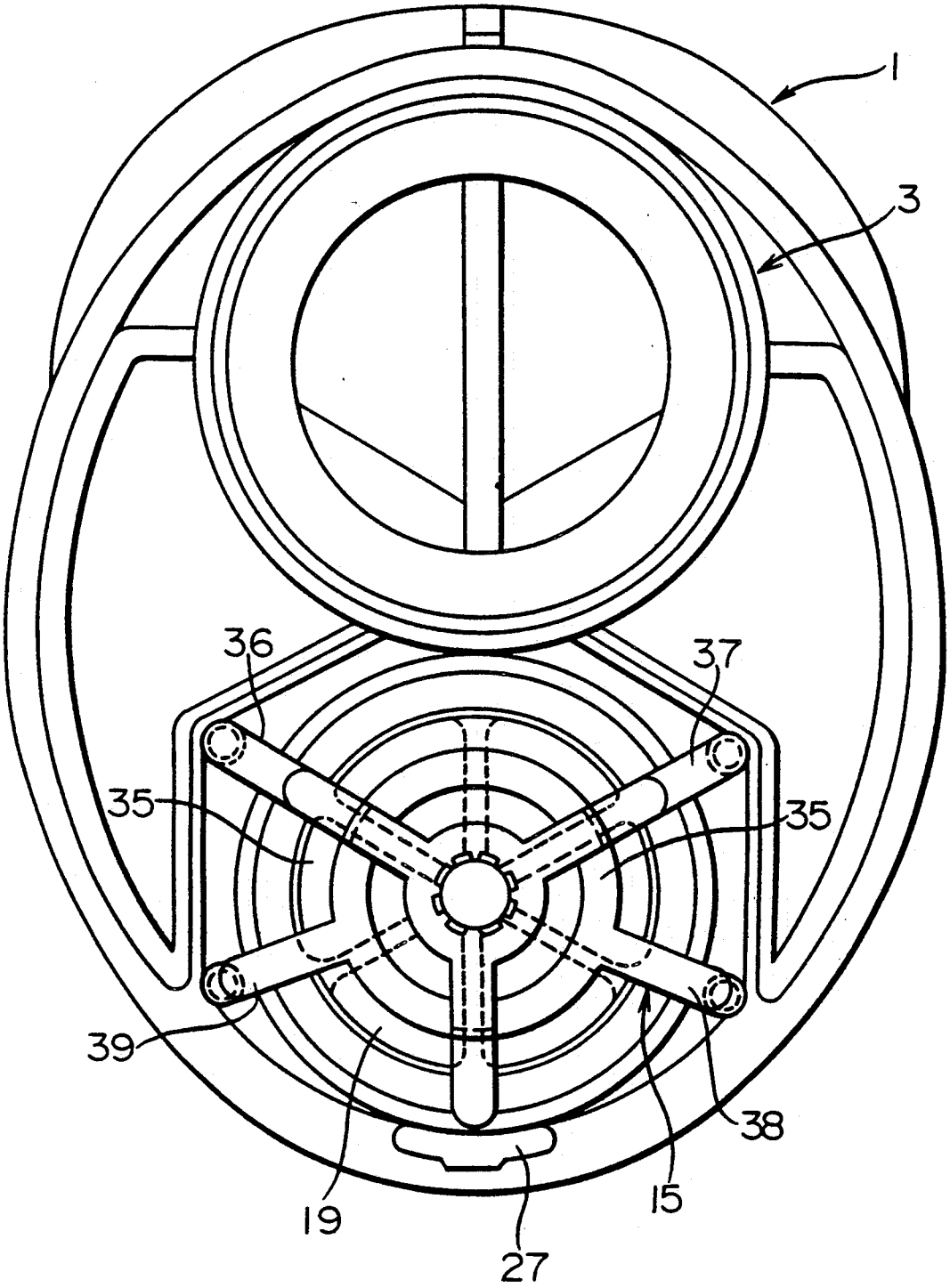
FIG. 2 is a front view of the respiration air chamber shown in FIG. 1, in which an exhalation valve cover is removed.
Figure 3:
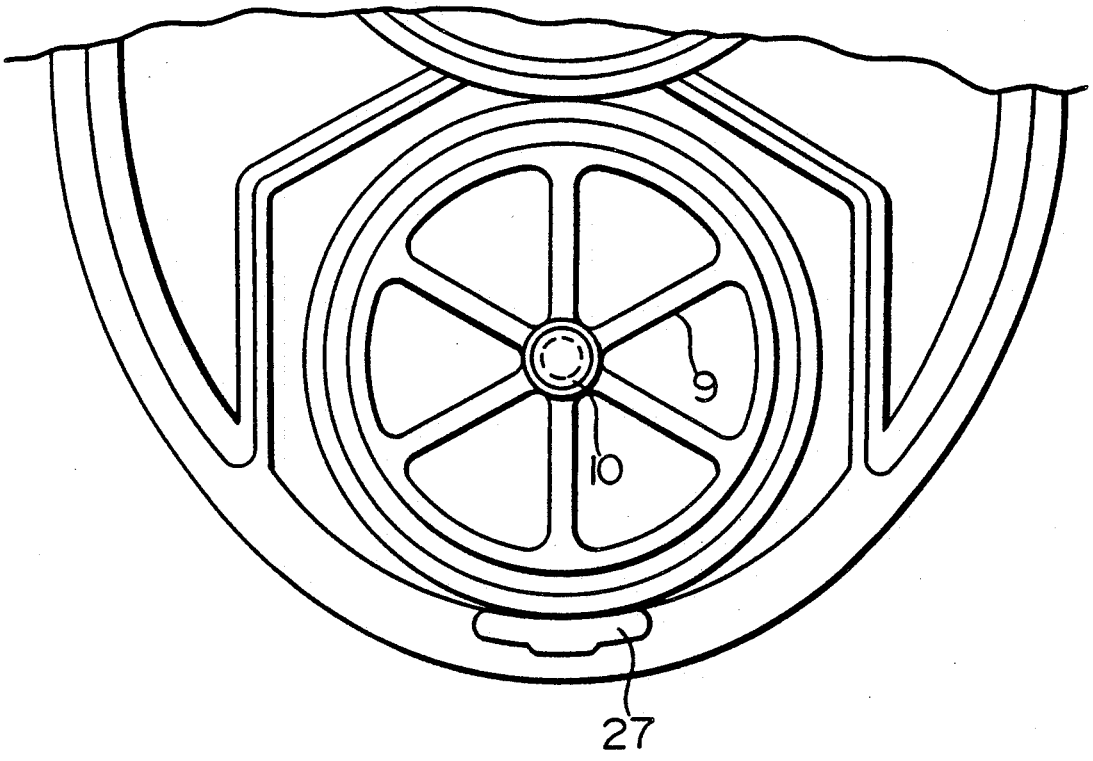
FIG. 3 is a partially cutaway front view of the respiration air chamber shown in FIG. 2, in which the valve body unit is removed.
Figure 4:
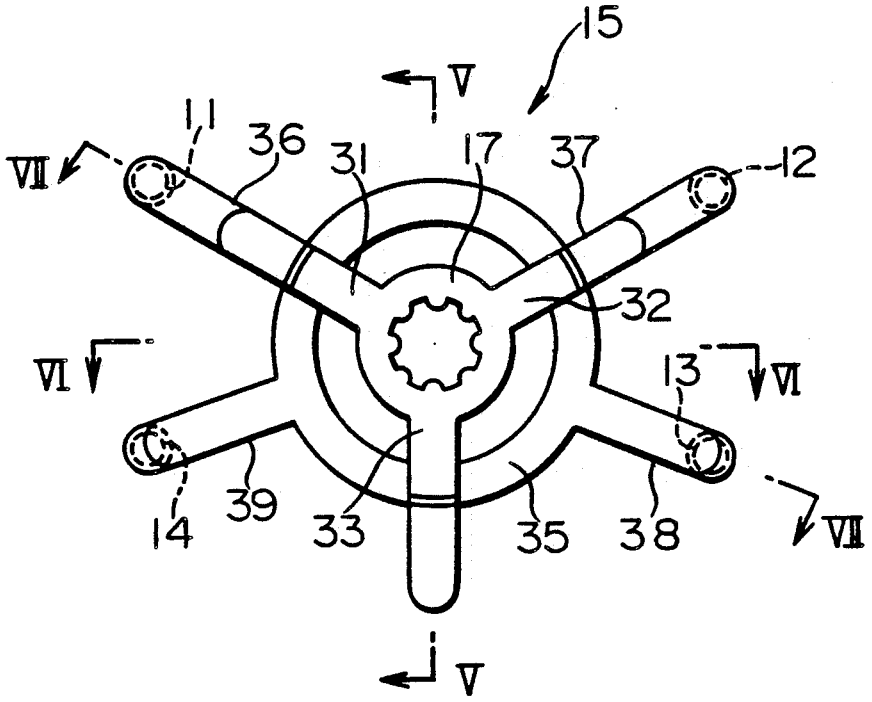
FIG. 4 is a front view of the valve body supporting member 15, which has been taken out of the exhalation valve chamber 5.
Figure 5:
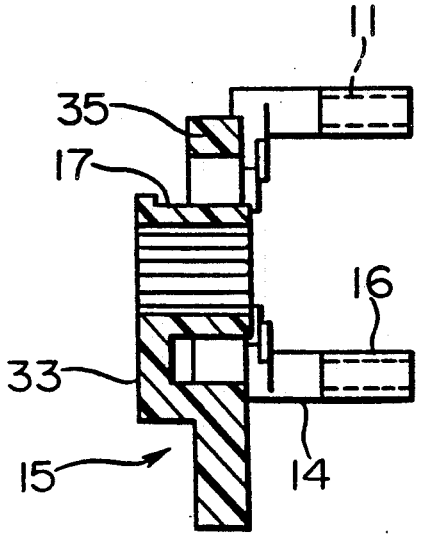
FIG. 5 is a sectional view taken along the line V—V of FIG. 4.
Figure 6:
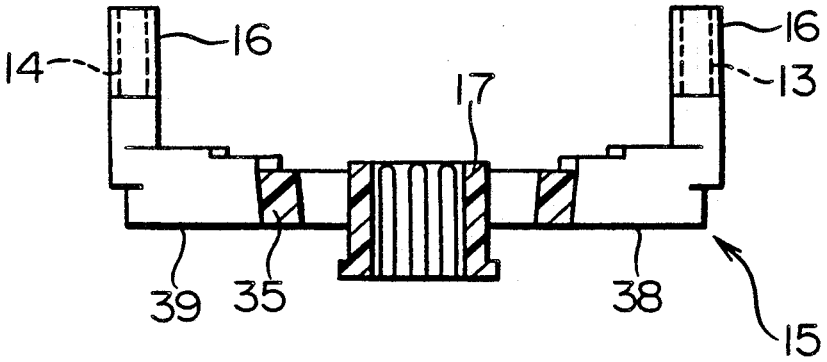
FIG. 6 is a sectional view taken along the line VI—VI of FIG. 4.
Figure 7:
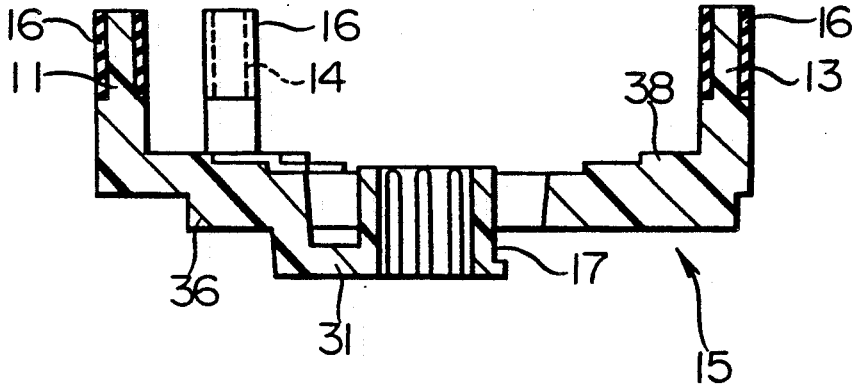
FIG. 7 is a sectional view taken along the line VII—VII of FIG. 4.

Referring to FIGS. 1 to 3, reference numeral 1 designates a respiration air chamber. The respiration air chamber comprises an inhalation air duct receiving opening 3, an exhalation valve chamber 5, and a portion 7 for fitting a speaking diaphragm or a speaking membrane. The exhalation valve chamber 5 is provided with an exhalation valve seat body 9 which constitutes a bottom of the chamber, and a valve body supporting member 15 that is detachably and firmly mounted by four supporting legs 11, 12, 13 and 14 which are inscribed to the angle portions of the side walls of said exhalation valve chamber 5 which forms approximately a hexagon. A bearing cylinder 17 is provided at the center of the valve body supporting member 15, and a cylindrical valve stem 21 projecting from the center of a valve body 19 is slidably fitted in the bearing cylinder 17 (see FIG. 2). A coil spring 23, which presses the valve body against the exhalation valve seat and surrounds the bearing cylinder 17 and the valve stem 21, is arranged between the valve body supporting member 15 and the valve body 19. The strength of said coil spring 23 is selected to be responsive to the positive pressure within the respiration mask. Additionally, in FIGS. 1 to 3, reference numeral 25 designates an exhalation valve cover, reference 27 a stopping projection for the exhalation valve cover 25, and reference 29 a mask body of rubber.

Referring to FIGS. 4 to 7, the bearing cylinder 17 is connected to a ring body 35 which surrounds the cylinder 17, through three connecting arms 31, 32 and 33 which are circumferentially spaced apart from each other and are extending radially outward from the outer periphery of the cylinder 17. Four supporting arms 36, 37, 38 and 39 extend radially outward while mutually spacing from the ring body 35 and the respective supporting arms 36, 37, 38 and 39 are provided at their outer ends with the supporting legs 11, 12, 13 and 14 approximately at right angles with said arms. A row of grooves which are formed in the inner peripheral surface of the bearing cylinder 17 and axially extend mutually in parallel are to reduce friction. The bearing cylinder 17, the connecting arms 31 to 33, the ring body 35, the supporting arms 36 to 39, and the supporting legs 11 to 14 are formed in one body. The valve body supporting member 15 is usually constructed in such a manner that it may be retained in its mounting position even by the exhalation valve cover 25. In the drawings, reference numeral 10 designates a stub of the exhalation valve seat body 9, which is used for mounting a membrane valve body used when converting the respirator to the non-positive pressure type, and reference numeral 16 designates a friction tube of rubber or the like, which is fitted onto the supporting legs 11 to 14 of the valve body supporting member 15 for increasing the engaging friction. In the embodiment abovementioned, the mounting means for the membrane valve body is the stub 10, but in case the membrane valve body is of umbrella shape having a mounting stem, the exhalation valve seat body 9 is provided with an opening which receives and retains the stem of the membrane valve body, instead of the stub 10.

Although, in the above-mentioned embodiment, the valve body supported by the valve body supporting member is energized toward the valve seat by the coil spring, it will be also all right if the valve body may be energized by magnetic force instead of by the coil spring.

In the above-mentioned embodiment, the present invention has been described with reference to a exhalation valve chamber which constitutes part of the respiration air chamber, but the present invention can naturally be applied also to an independent, separate exhalation valve chamber.

While there has been described a preferred form of the invention herein, modifications and variations are obviously possible in the light of the above teachings. It is therefore to be understood within the scope of the appended claims that the invention may be practiced otherwise than as specifically described above.

What is claimed is:

1. An exhalation valve apparatus in combination with a respiration mask, said apparatus including a valve chamber and a valve body unit which is mounted within said valve chamber when the respirator mask is used as a positive pressure type mask and which is taken out of said valve chamber when the mask is used as a non-positive pressure type mask, and a valve housing which defines said valve chamber and which includes an exhalation valve seat body including a valve seat and further including means for mounting a membrane valve body within said valve chamber when said valve body unit is taken out of said valve chamber, said valve body unit comprising a valve body supporting member including mounting means for detachably mounting said valve body supporting member within said valve chamber, a valve body which is supported by said valve body supporting member and movable between a first position wherein said valve body is brought into contact with said valve seat of said exhalation valve seat body and a second position wherein said valve body is separated from said valve seat, and means for urging said valve body towards said valve seat under a desired pressing force.

2. An exhalation valve apparatus for a respiration mask, according to claim 1, wherein said mounting means comprises a plurality of leg pieces which are in contact with the inner surface of the side walls of said exhalation valve chamber.

3. An exhalation valve apparatus for a respiration mask, according to claim 1, wherein the means for urging said valve body toward said valve seat under a desired pressing force comprises a spring.

4. An exhalation valve apparatus for a respiration mask, according to claim 1, wherein the membrane valve body mounting means comprises a mounting stub projecting outwardly from said valve seat body.

5. A valve body unit, in combination with a conventional non-positive pressure-type respiration mask including an exhalation chamber having a valve seat therein, for when mounted within said exhalation valve chamber of said mask, converting said mask into a positive pressure type mask, said valve body unit comprising a valve body supporting member including means, including a plurality of leg members, detachably and securely mounting said unit within said exhalation valve chamber of the respiration mask by engagement of said plurality of leg members with the inner surface of the side walls of the exhalation valve chamber, a valve body which is supported by said valve body supporting member and is movable between a position where the valve body is brought into contact with said valve seat in the exhalation valve chamber and a position where the valve body is separated from said valve seat, and means urging said valve body towards said valve seat under a desired pressing force.

6. A valve body unit for a respiration mask, according to claim 5, wherein the means for energizing said valve body toward said valve seat under a desired pressing force comprises a spring.

* * * * *